US005865012A

United States Patent [19]

Hansson et al.

[11] Patent Number: 5,865,012

[45] Date of Patent: Feb. 2, 1999

[54] PROCESS AND APPARATUS FOR FILLING COHESIVE POWDERS

[75] Inventors: Henri Hansson, Dösjebro; Jan Petersson, Lund, both of Sweden; Peter Claussnitzer, Backnang, Germany

[73] Assignee: Astra Aktiebolag, Sodertaije, Sweden

[21] Appl. No.: 454,394

[22] PCT Filed: Feb. 6, 1995

[86] PCT No.: PCT/SE95/00109

§ 371 Date: Jun. 20, 1995

§ 102(e) Date: Jun. 20, 1995

[87] PCT Pub. No.: WO95/21768

PCT Pub. Date: Aug. 14, 1995

[30] Foreign Application Priority Data

Feb. 11, 1994 [SE] Sweden ..... 9400462

[51] Int. Cl.[6] ..... B65B 1/24

[52] U.S. Cl. ..... 53/436; 53/453; 53/454; 53/529; 100/238; 100/295

[58] Field of Search ..... 53/436, 438, 121, 53/529, 453, 454, 559, 560; 100/238, 295

[56] References Cited

U.S. PATENT DOCUMENTS 4,223,512 9/1980 Buchner ..... 53/453

FOREIGN PATENT DOCUMENTS

| | | | |
|---|---|---|---|
| 191258 | 8/1986 | European Pat. Off. | G01F 13/00 |
| 455463A1 | 11/1991 | European Pat. Off. | A61M 15/00 |
| 3023143 | 6/1980 | Germany | B65B 9/04 |
| 3141069 | 10/1981 | Germany . | |
| 591856 | 7/1977 | Switzerland | A61J 3/07 |
| 613041 | 8/1979 | Switzerland | G01F 13/00 |
| 2237258 | 5/1991 | United Kingdom | B65B 9/04 |
| WO92 17149 | 10/1992 | WIPO | A61J 3/07 |

OTHER PUBLICATIONS

Pct International Search Report.

*Primary Examiner*—James F. Coan
*Assistant Examiner*—Gene L. Kim
*Attorney, Agent, or Firm*—Fish & Richardson P.C.

[57] ABSTRACT

The invention relates to a device for filling with high accuracy a finely divided powdered medicament having a particle size smaller than 10 μm into cavities having a size corresponding to the volume of powder to be filled, wherein said device comprises oscillating and rotating means for breaking down aggregates formed in the finely divided powdered medicament and filling and for compacting it in said cavities. The invention also includes a method of filling with high accuracy of a finely divided powdered medicament having a particle size smaller than 10 μm and to fill said finely divided powdered medicament into cavities, wherein the finely divided powdered medicament is transported and compacted in said cavities by oscillating and rotating means.

19 Claims, 5 Drawing Sheets

PROCESS AND APPARATUS FOR FILLING COHESIVE POWDERS

TECHNICAL FIELD OF THE INVENTION

The invention relates to device for filling, with high accuracy, finely divided powdered medicament having a particle size smaller than 10 μm.

BACKGROUND OF THE INVENTION

Powders consisting of very small particles are commonly used in the inhalation therapy where the size of the particles are of utmost importance. The diameter of particles which are to be inhaled must be less than 10 μm, preferably between 6 to 1 μm, to ensure adequate penetration of the particles into the bronchial area of the lungs.

Most finely divided powdered medicaments, such as micronized powders, are light, dusty and fluffy and they often create problems during handling, processing and storing. For particles having a diameter less than 10 μm the van der Waals forces are generally greater than the force of gravity and consequently the material is cohesive and tends to form irregular agglomerates. Powders having such particle sizes are also very sensitive to electrostatic charges which readily arise in such powders during handling. These powders have very poor free-flowing properties and during handling bridges between the particles will be formed leading to the build up of the aggregates.

When finely divided powders are to be filled into reservoirs, compartments, cavities or depressions of different kind and sizes, such as cavities provided on an elongate carrier, for example a layer of foil, a piece of moulded plastic or similar, the aggregates must be broken down in order to make possible the filling of the powder into the cavities. One way of avoiding the build up of aggregates and to break down those that have been formed is to subject the finely divided powder to movement, e.g. agitation. This could be done by using mechanical devices, such as stirring means, or by using electronical means such as means creating ultra sound or similar.

This break-down of aggregates is especially important when small amounts, e.g. between 10 mg to 0.1 mg, in particular 5 mg to 0.5 mg, of finely divided powdered medicaments are to be filled into cavities formed to receive the required exact amount of the powder.

Another important factor when filling medicaments is the degree of compaction. This is especially important when filling finely divided medicaments into cavities which, in particular, are to be used for inhalation with breath-actuated, dry-powder inhalators, as the medicament must be lifted out of the cavities by the force created by the airstream produced by the patient during inhalation.

The powder present in the cavities must also be able to break down into the particles having a particle size smaller than 10 μm during inhalation in order to provide a dose comprising high proportion of particles within the respiratory range of less than 10 μm. The compaction may therefore not be too strong. On the other hand, in order to avoid the possibility that the medicament falls out of the cavity when it is positioned for inhalation but before it has been inhaled, the medicament must be compacted to a certain degree so that it is retained in the cavity until inhalation. A controlled compaction is therefore of utmost importance.

PRIOR ART

It is known in the prior art to provide different types of apparatus for filling medicaments into capsules. In CH-B591 856 is a device for forming and filling capsules with fluid medicament described.

U.S. Pat. No. 2,807,289 describes a device for filling small bottles with antibiotics. According to this document a powdered medicament is fed to an outlet by using a screw device where each turn on the screw meters a certain amount of powder. Such an apparatus cannot be used in modern inhalation technology as the amount of powder which is to be filled into cavities is very small compared with the amount of antibiotic filled into bottles. It is not possible to fill very small amounts sufficiently in an accurate manner with the apparatus described in this document.

A method of filling very small amounts of finely divided powders is described in EP-A-0 237 507. According to this document aggregates of finely divided powdered medicament are fed to cavities provided on a dosing unit, e.g. a perforated membrane or disc. The exact dose is filled by breaking down the aggregates by using scrapers activated by a manual turning of the dosing unit. This method is used in the breath-actuated, dry powder inhaler called Turbuhaler®. However, a method according to this document is not possible to modify to provide a method of continously filling cavities provided on an elongate carrier or similar in accordance with the present invention. It is especially difficult to modify the method to be used industrially. It is also commonly known in the prior art to use different types of apparatus for filling resevoirs in copying machines and for feeding powder in such machines. However, in this case the accuracy of the fed doses is of less importance compared with the demands of accuracy when filling exact doses of pharmaceuticals, in particular when filling highly potent pharmaceuticals to be used, for example, in inhalation therapy. As none of the known devices are dealing with the present problem of filling and compacting finely divided powdered medicaments for the inhalation therapy a solution to the stated problem is not found in the prior art.

THE INVENTION

The present invention relates to a device for filling with high accuracy a finely divided powdered medicament having a particle size smaller than 10 μm into cavities, preferably provided on an elongate carrier or similar, such as cavities formed on an aluminium or plastic layer or tape.

In the following description the wording "small amount" relates to amounts having a weight between 10 to 0.1 mg, in particular between 5 and 0.5 mg.

The invention provides a device for filling with high accuracy a finely divided powdered medicament having a particle size smaller than 10 μm into cavities having a size corresponding to the amount of powder to be filled, wherein said device comprises oscillating and rotating means breaking down aggregates formed in the finely divided powdered medicament and for filling and compacting it in said cavities.

The invention further provides a method of filling with high accuracy a finely divided powdered medicament, having a particle size smaller than 10 μm into cavities having a size corresponding to the amount of powder to be filled, wherein the finely divided-powdered medicament is transported to and compacted in said cavities by oscillating and rotating means.

Further preferred embodiments of the method and the device according to the invention are clear.

The present invention further provides a method and an apparatus for manufacturing an enlongate member with cavities containing finely divided powdered medicament.

There is also provided the use of the method and device according to the invention for filling a finely divided powdered medicament into cavities of a single unit dose, breath-actuated, dry powder inhalator, said cavities being present on an elongate carrier, as well as for filling such medicaments into cavities of an elongate carrier to be provided in a multi-dose, breath-actuated, dry powder inhalator for multiple use.

The cavities could preferably be provided, e.g. preformed, on an elongate carrier and have a size which is determined by the amount of powder to be filled into the cavities.

The greatest amount of finely divided powdered medicament which can be filled into the cavities using the filling device according to the invention in the embodiments described in the description is 10 mg and the smallest amount is 0.1 mg, but by modifying the filling head within the scope of the appended claims other amounts could also be filled. In the preferred embodiments the cavities could have a volume between 0.5 and 25 $mm^3$ corresponding for many medicaments to a dose of 0.1 and 10 mg, respectively. In the preferred embodiment of the present invention the cavities have a volume between 0.5 to 12 $mm^3$ corresponding to a dose of 0.1 to 5 mg, most preferably between 2 to 12 $mm^3$ corresponding to a dose of 0.5 to 5 mg.

The construction of the filling head according to the invention provides a solution to the problem of filling exact quantities of a finely divided powder into cavities in an continous manner to be used industrially. The device and method also makes it possible to solve the problem of filling cavities of an elongate member whereby the waste of material is minimized.

DETAILED DESCRIPTION OF THE DRAWINGS

Figure 1:
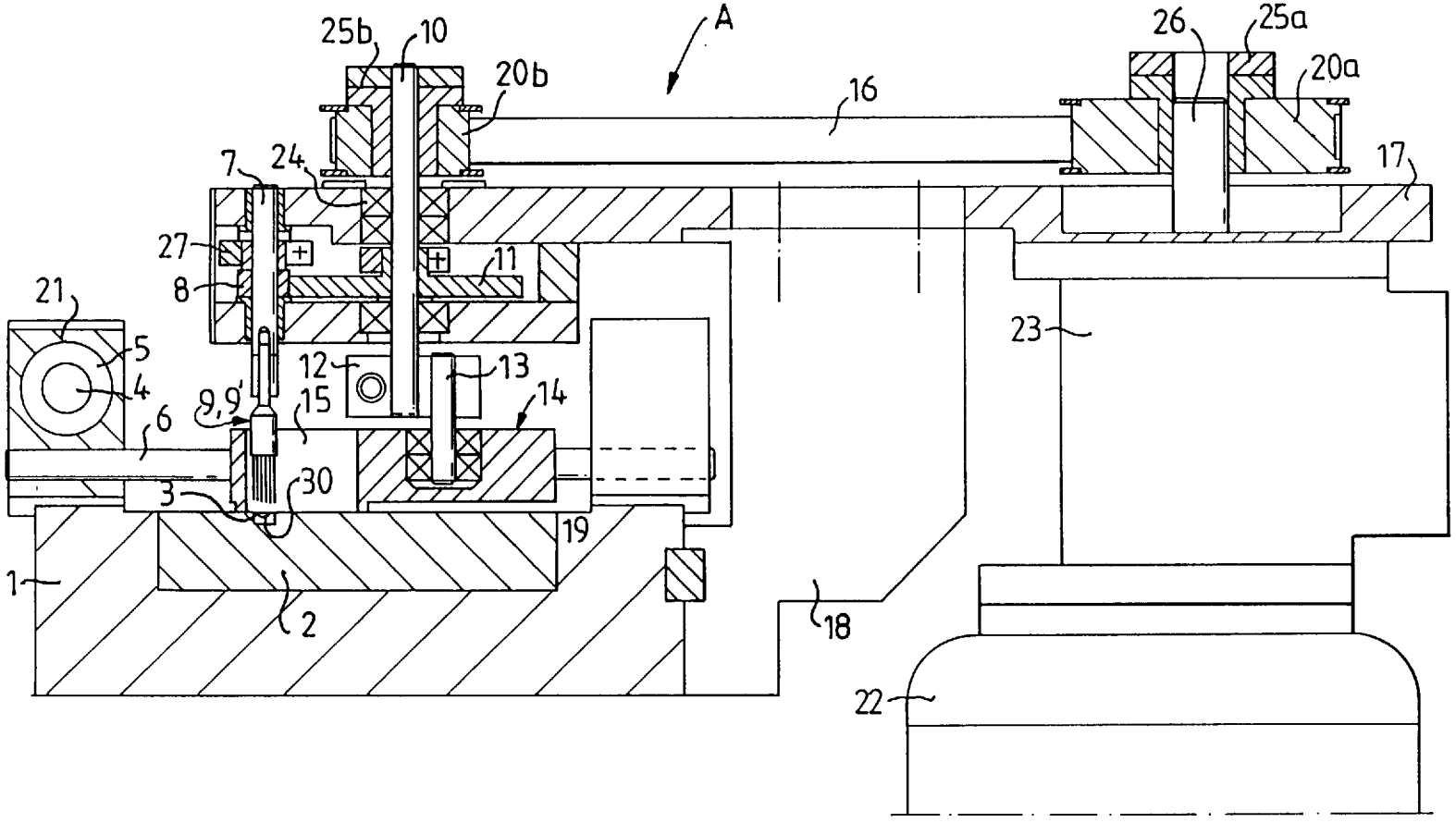
FIG. 1 shows a preferred embodiment of the device according to the invention in a side view.
Figure 2:
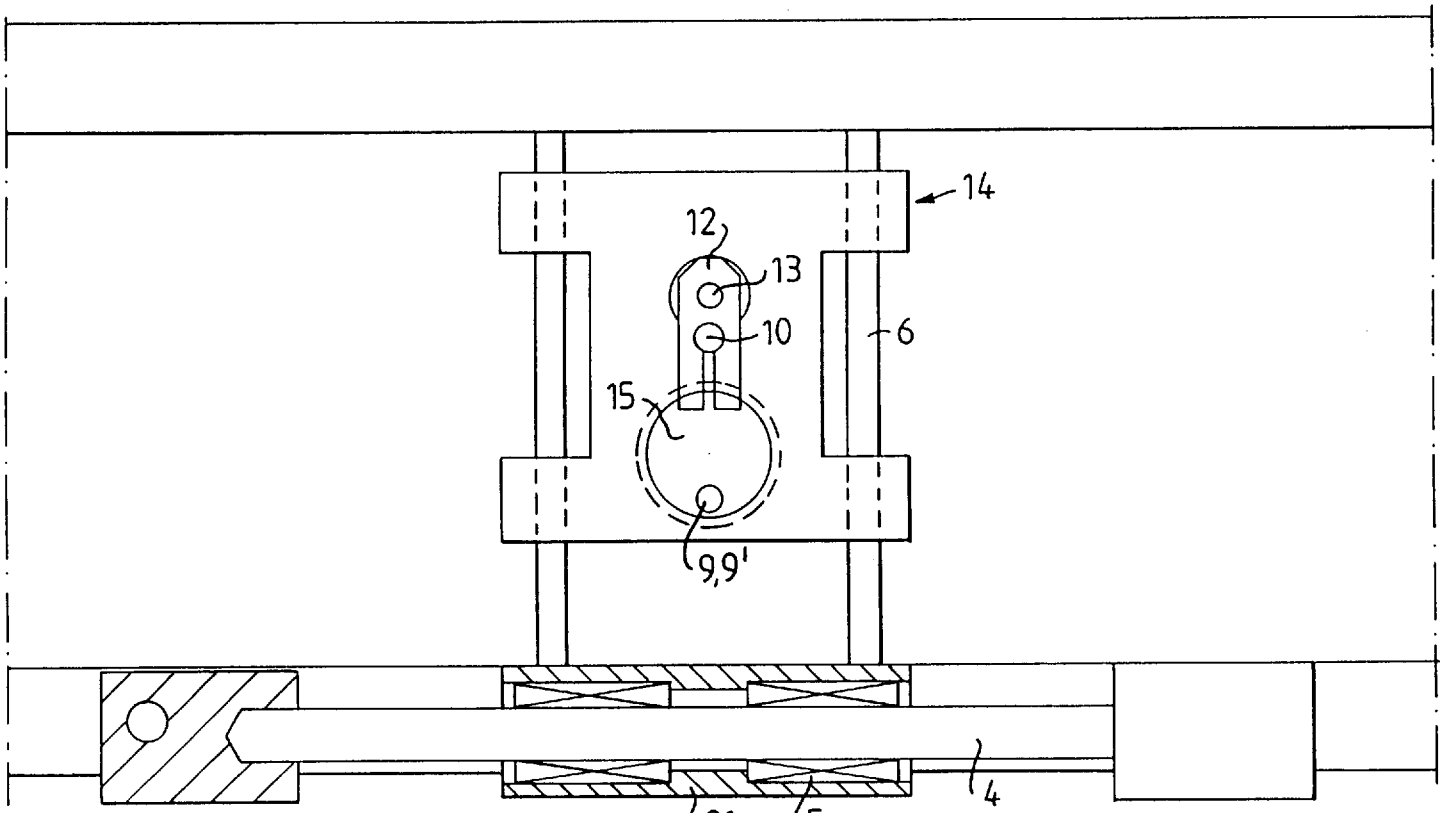
FIG. 2 shows the device in FIG. 1 in a top view.

A preferred embodiment of the device according to the invention is shown in FIGS. 1 and 2. The device is intended to be used for filling with high accuracy finely divided powder, in particular pharmaceuticals, into cavities provided on an elongate member 3. Said elongate member 3 contains a plurality of the cavities 30 arranged in a row.

The device comprises a supporting frame 17 and a filling head 14. The supporting frame consists of a beam construction and is at one end mounted on a stand including a motor 22 and a gear box 23. The other end of the supporting frame 17 provides a support for the filling head 14 and a stirring element 9 arranged in the filling head.

The filling head 14 consists of a substantially I- formed element and is provided with a powder compartment 15 acting as a powder supply during the filling action. Said powder compartment 15 is in the form of a substantially circular groove provided eccentrically in and close to one edge of the filling head 14.

Figure 3:
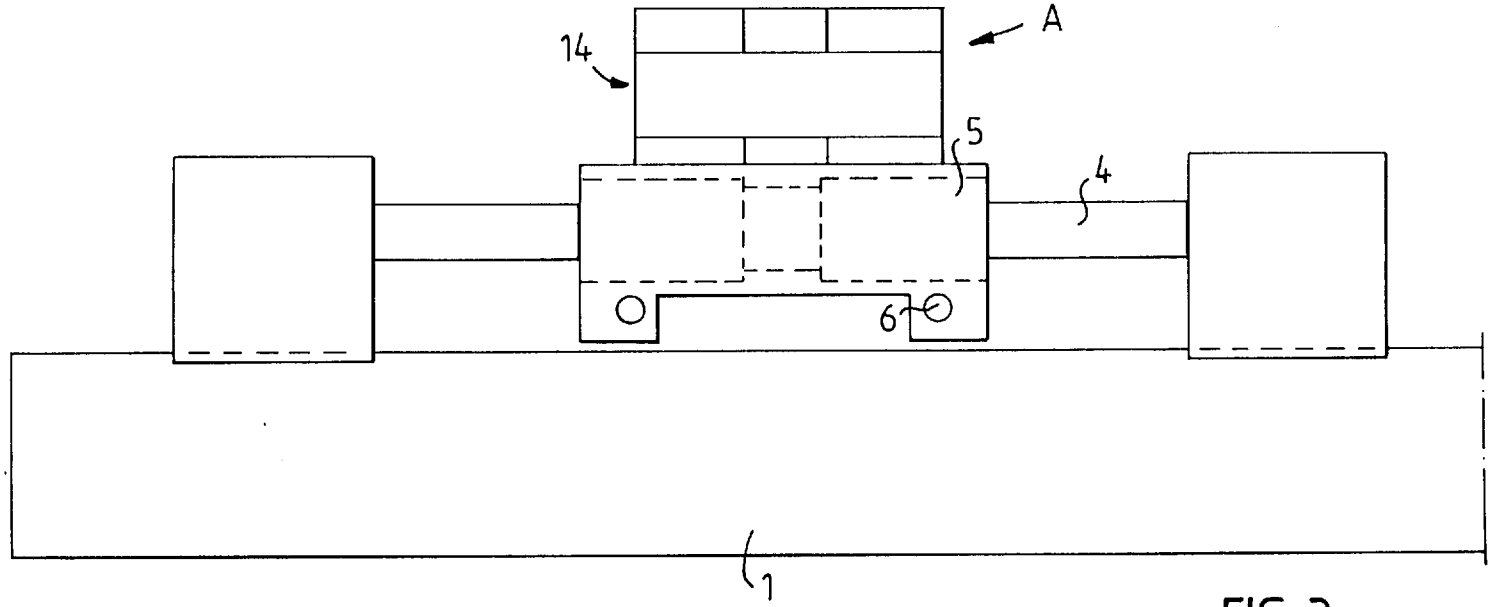
FIG. 3 shows the device in FIG. 1 in a front view.

The filling head 14 is mounted on two sets of guides 4, 6 mounted perpendicular to each other. The first set of guides 4 are provided parallel to the feeding direction of the elongate member 3 when this is arranged in the apparatus according to the invention, see FIGS. 3 and 4. The second set of guides 6 are mounted perpendicular to the first set of guides 4 as can be seen in FIGS. 1 and 2. The filling head 14 is mounted on this second set of guides 6. During the filling action the filling head is placed directly above the cavity which is to be filled in the row of cavities arranged on the elongate member 3. The guides 4 are mounted with bearings 5 in a supporting beam 21. Said supporting beam 21 is arranged on a crane balks 1 provided with a bottom plate onto which the elongate member 3 is placed for the filling process. The supporting frame 17 are mounted on a mounting element 18, which is mounted on crane balks 1.

A shaft 13 is arranged eccentrically in the filling head 14 adjacent the powder compartment 15. The shaft 13 is fixedly mounted in the filling head by bearings 19. Said shaft 13 extends upwardly from the filling head and is mounted in a linking arm 12.

A main shaft 10 is provided and arranged with one end adjacent the shaft 13 in the linking arm 12. The main shaft 10 extends upwardly through gear wheels 11 and is mounted in bearings 24 in the supporting frame 17. The other end of the main shaft 10 extends beyond the supporting frame 17 as can be seen in FIG. 1. The main shaft 10 is connected to a motor 22 via a transmission belt 16 and a pair of driving wheels 20*a*, 20*b*. One of the driving wheels 20*b* is arranged with a pin 25*b* on the main shaft 10 and the other driving wheel 20*a* arranged with a pin 25*a* on a motor shaft 26 extending from the motor 22 and a gear box 23.

A stirring element 9, 9' is arranged in the powder compartment 15 of the filling head 14 and is rotated during the filling action. Said stirring element 9, 9' is in the preferred embodiment formed as an elongate element having substantially two parts 9*a*, 9*a* and 9*b*, 9*b*'. The first part 9*a*, 9*a*' is formed as a transporting element which in a first preferred embodiment is substantially circular and formed as a brush 9*a* having bristles 9*c*, as can be seen in FIG. 4*a*.

Figures 4A, 4B, 5:
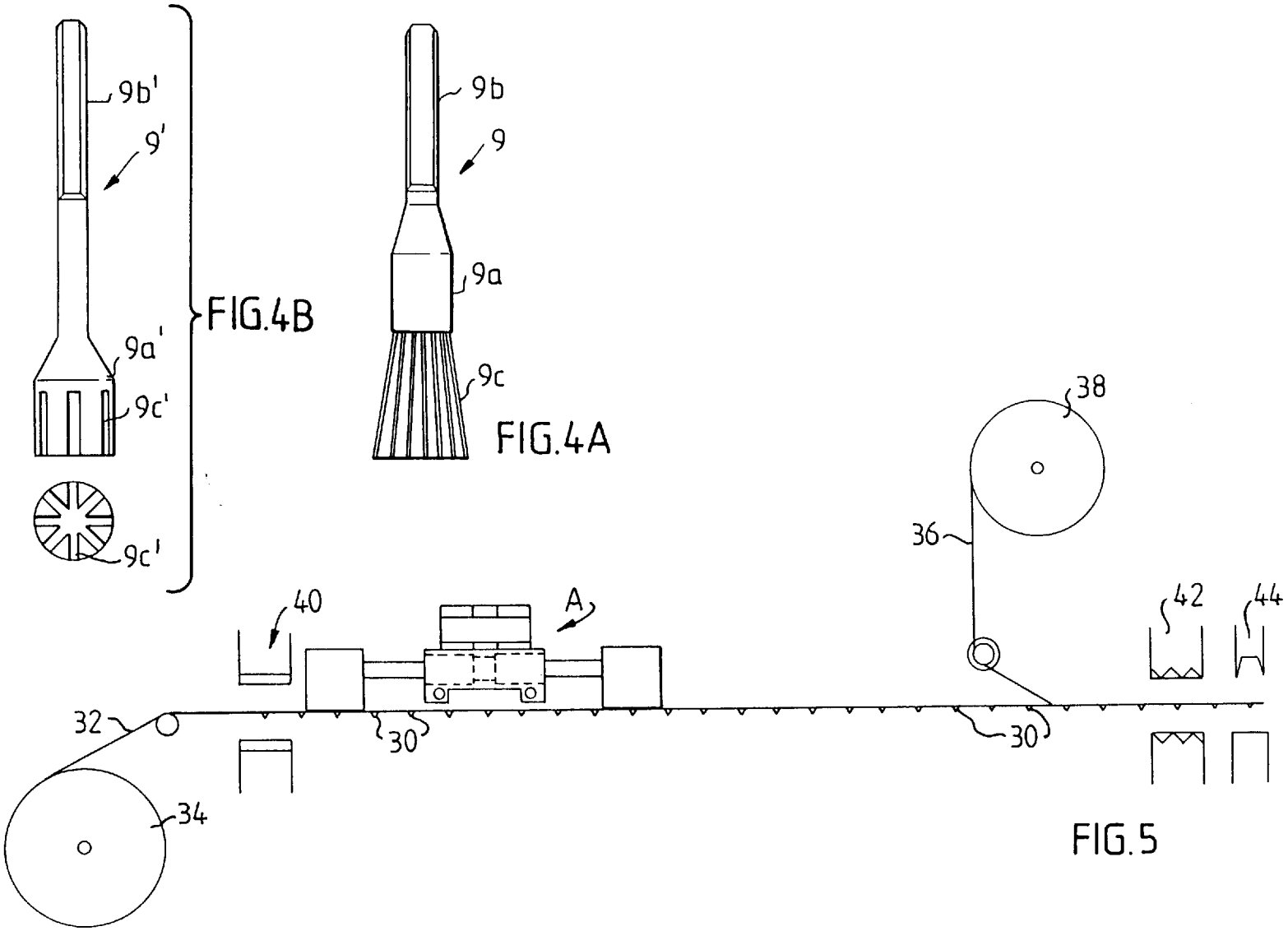
FIG. 4*a* shows a first embodiment of the stirring device 9 in FIG. 1.
FIG. 4*b* shows a second embodiment of the stirring device 9' in FIG. 1.
FIG. 5 shows the device according to the invention mounted in a preferred embodiment of an apparatus for continuous production and filling of a strip of material of an elongate carrier provided with cavities.

In a second embodiment the first part 9*a*' is formed as a substantially cylindrical, rigid element in which cut outs or grooves 9*c*' are provided, as shown in FIG. 4*b*. The second part 9*b*, 9*b*' is formed as a shank for the first part and is mounted in a shaft 7.

The shaft 7 is mounted through bearings 27*a*, 27*b* in the supporting frame 17, as shown in FIG. 1. A pair of gear wheels 8 are arranged around the shaft 7 and in acting contact with the gear wheels 11 of the main shaft 10. Said gear wheels 8, 11 are provided with lockings 21.

During operation of the filling device finely divided powder is supplied to the powder compartment of the filling head 14. This could be done in any suitable manner but in the preferred embodiment a screw feeder of a known type is used, but any other type of powder feeder could be used. As mentioned above aggregates and bridges will be formed in the powder in the powder compartment 15 and have to be broken down in order to make filling of the cavities possible.

In order to break down the aggregates formed in the powder compartment 15 the filling head 14 and the stirring element 9, 9' are moving. Due to the construction of the filling device the filling head 14 will describe an oscillating movement with regard to the cavity and the stirring element 9, 9'. The stirring element will rotate around its central axis within the oscillating powder compartment 15. The movements are described in more detail below.

A force is applied via motor shaft 26 by the motor 22 to the driving wheel 20*a*. The transmission belt 16 transferres the rotation of the driving wheel 20*a* to the driving wheel 20*b* and to the main shaft 10. The rotation of the main shaft 10 is transferred to the linking arm 12 and to the shaft 13 of the filling head 14. Due to the eccentric mounting of the shaft 13 in the filling head 14, the filling head will describe a oscillating movement in relation to the elongate element 3, the cavity 30 arranged under the filling head and the stirring element 9, 9'. The rotation of the main shaft 10 is also transferred to the shaft 7 of the stirring element 9, 9' via gear wheels 11 and 8. Rotation of the shaft 7 will provide the stirring element 9, 9' with a rotation around its central axis. The stirring element 9, 9' is thereby fixed in the horizontal directions and is only rotating around its central axis.

The motor 22 is in the preferred embodiment electrical but other kinds of motors, such as pneunatic or hydraulic, can be used.

The function of the stirring element 9, 9' will now be described. When the cohesive powder is filled into the powder compartment 15 and this is oscillating around the stirring element 9,9' powder will be built up between the stirring element 9, 9' and the edges of the powder compartment 15. Due to the rotation and construction of the stirring element powder will be moved from the build up of powder into the center of the first part 9*a*, 9*a'* of the stirring element and forced down into the cavity 30. This rotational force will also provide a compaction of the powder in the cavity, as powders' is continuously forced down into the cavity during the filling action. A controlled compaction is achieved by optimizing the amount of rotations of the stirring device.

The bristles 9*c* of the first embodiment of the stirring element 9 have been shown to be very efficient in transporting powder from the build-up within the powder compartment 15 to the cavity and provides also sufficient force to give the powder the required compaction within the cavity. The cut outs 9*c'* provided in the rigid element 9*a'* of the second embodiment of the stirring element functions in the same manner as the bristles 9*c* and has also shown to be effective for the transportation of powder from the powder compartment to the cavity as well as providing a sufficient compation of the powder in the cavity.

The amount of oscillating of the filling head 14 is dependant of the characteristics of the powder and on the amount of powder to be filled in each cavity. Tests have shown that in order to fill the required amount of powder into the cavities and to give the powder in the cavity the required degree of compaction the filling head shall rotate preferably 1 to 6 times, more preferably 3 times, over the cavity but this is related to the characteristics of the powder and may vary between different powders. The form and size of the crystals and the cohesivness of the finely divided powder, as well as the content of moisture and the ability to equalize the electrostatic forces created in the powder are characteristics which determine how easily the powder can be compacted and thereby determining the number of times the filling head must rotate over the cavity to provide the required degree of compaction.

It has been shown that when filling finely divided powdered substances having a particle size smaller than 10 $\mu$m, such as budesonide, lactose, terbuthalinesulphate as well as mixtures of these substances, the amount of times which the filling head has to rotate over the cavity is about 3. With 1 rotation the compaction is too loose and the powder may fall out of the cavity during handling; and 6 rotations do not add any substantial further compaction to the powder in the cavity when powders of the above mentioned type are filled.

It has also been found that other finely divided powdered medicaments having other crystal structures may require further degree of compaction leading to an increased number of times which the filling head needs to be rotated over the cavity.

In the preferred embodiment the filling head 14 comprising the powder compartment 15 as well as the stirring element are made of a material which gives rise to a minimum of electro-static charges so that a minimum amount of the finely divided powder accordingly adheres to these parts of the device. The material must also have a low friction relative to the material of the elongate member 3 (cf FIG. 3) in which the cavities are provided, as the edges of the powder compartment are moving in contact with the elongate member during operation of the device. Materials useful for this purpose are plastics, such as carbon-treated plastics, for example POM, metals, such as aluminium or stainless steel, or mixtures of plastics and metals, such as, for example, aluminium covered with PTFE or carbon-filled POM. The fact that the edges of the powder compartment 15 of the filling head 14 is in contact with the edges of the cavity and the surrounding material is important for the filling of the cavity as this avoids leakage of powder between the filling head and the elongate member. Such leakage will give rise to an unwanted waste of powder.

The stirring element is arranged over the cavity with a distance up to a few millimeters. This distance may vary due to different characteristics of different powders but tests have shown that the optimum distance is about 1 mm. In order to further increase the compaction of the powder in the cavity a reciprocating movement could be applied to the stirring element 9,9'. This reprocating movement could be provided by a pneumatic cylinder arranged on or in contact with the shaft 7. The suitable length of each stroke is between 0.5 to 10 mm.

In FIG. 5 an apparatus according to the invention is shown mounted in a so called blister machine for production of an elongate carrier such as a tape, web or belt provided with the cavities 30 which are to be filled with finely divided powdered medicament. Such a blister machine is well known in the state of the art and is normally provided with several stations in which the different production steps are performed. In this manner several different steps are performed mutually to different parts of the elongate member. After the completion of one step the elongate member is transported one step forward and the steps are repeated. The application of this type of machine for the production of an elongate member having cavities filled with an exact quantity of finely divided powder according to the present invention is now described in more detail.

The cavities on the elongate carrier are preferably produced in a first step whereby a first elongate member 32 is provided on a first roller 34. The elongate member 32 is fed to a forming station 40 where the cavities 30 are formed in any suitable known manner, such as thermo or cold forming or stamping. The elongate member 32 with the cavities 30 is fed to the filling device A for filling the finely divided powder into the cavities. When a cavity is positioned under the filling head 14 the oscillating movement of the filling head 14 and the rotational movement of the stirring element 9, 9' are initiated and the powder compartment 15 with the powder describes an oscillating movement. The stirring element 9, 9' rotates around its central axis in a fixed position in relation to the powder compartment and the cavity, whereby it rotates centrally over the cavity 30. Due to the rotational forces the finely divided powder particles are transported from the powder compartment to and compacted in the cavity.

After the filling of the cavities of the first elongate member 32 it is fed to a position where a second elongate member 36 fed from a second roller 38 is positioned on top of the first elongate member 32. The first and second elongate members 32 and 36 are thereafter fed to a welding or sealing station 42 where the second elongate member 36 is welded or sealed on to the upper side of the first elongate member 32. The welding or sealing may involve any known method, such as heat sealing, ultra sonic welding or any other suitable method.

The two elongate members are thereafter cut in cutting station 44 to the required size and packed to be placed in a multi-dose, breath actuated, dry powder inhalator or any other package.

Figure 6:
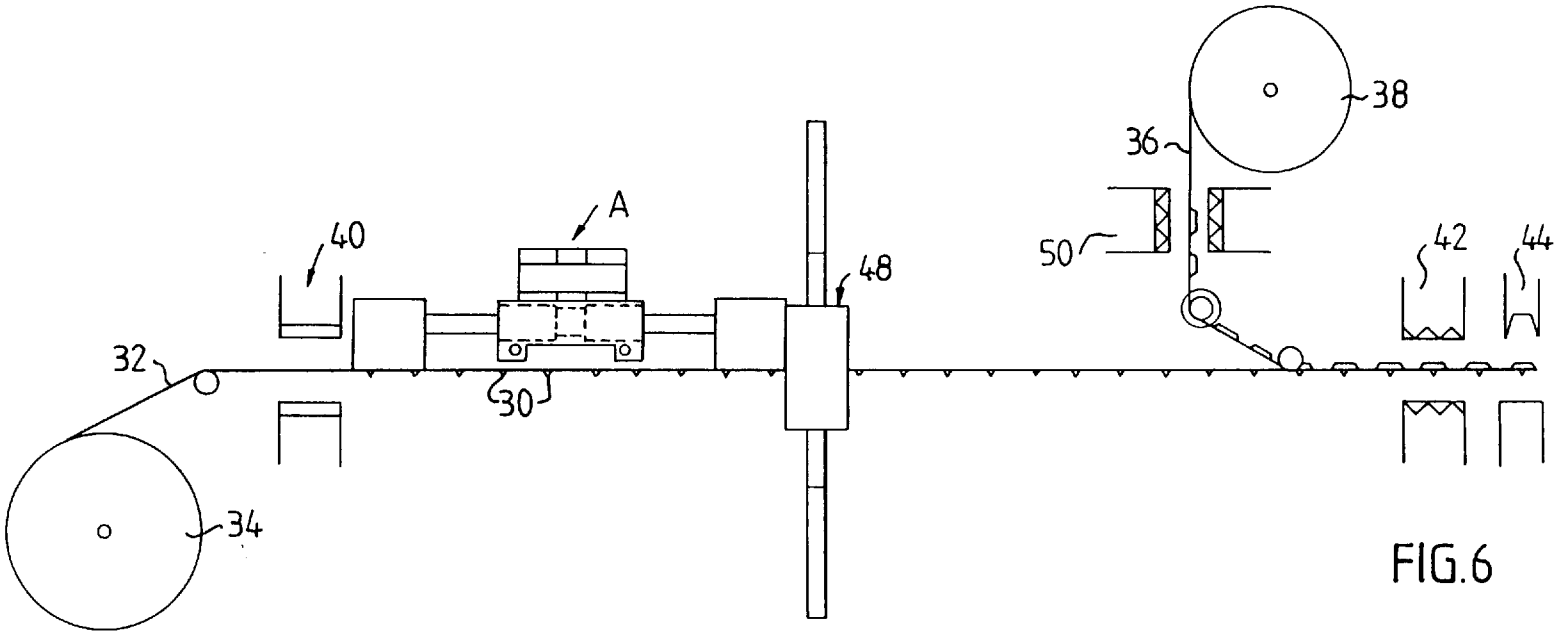
FIG. 6 shows a further preferred embodiment of the apparatus in FIG. 5.
Figure 7:
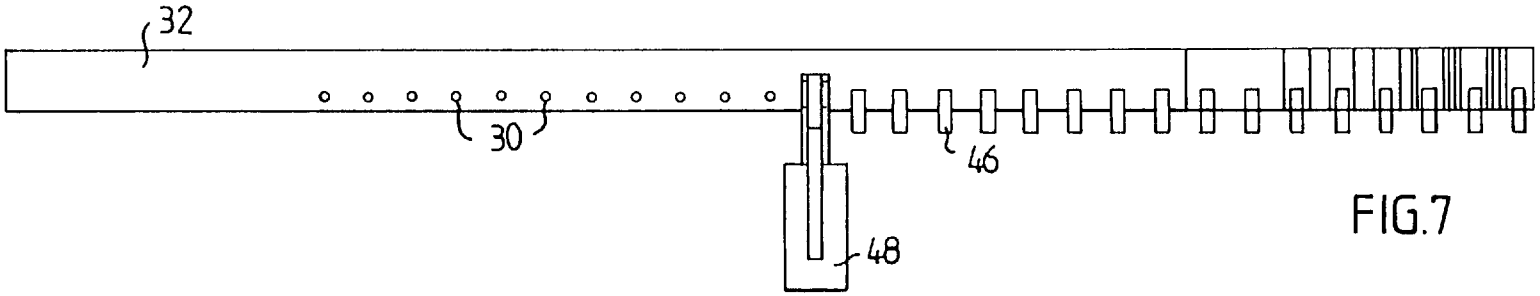
FIG. 7 shows a view from above of the elongate carrier with the cavities during the different operations of the apparatus in FIG. 6.

When the method according to the invention is used in the production of unit dose, breath actuated, dry powder inhalators for single use produced from an elongate carrier, three further stations are added to the apparatus described in FIG. 5 as can be seen in FIG. 6. An example of an inhalator of this type is described in WO 92/04069 and WO 93/17728; the contents of these two applications are incorporated herein by reference.

After the filling of the cavities 30, which is done in accordance with the process described above, each cavity is provided with a protective and sealing tape 46 at the station 48 (as shown in FIGS. 4 and 5). The cavities can also be provided with a hole in their lower part in order to facilitate the extraction of the dose into the inhalation channel during inhalation. In this case a second protective and sealing tape has to be provided on the lower side of the cavities on the first elongate member. This is done in the station 48 at the same time as the protective and sealing tape 46 is provided over the cavities on the upper side of the elongate member.

As shown in FIG. 4 the second elongate member 36 is formed in the forming station 50 in the required manner and is then placed on top of the first elongate member 32 with the filled cavities 30 and the two elongate members are fed to the welding station 42. After the welding or sealing the two elongate members are cut in a cutting station 44 to the unit dose inhalators.

The two elongate members may be produced from layers of any suitable material such as aluminium or different kinds of plastics as well as combinations thereof. Tests have shown that in the case where a unit dose inhalator is produced and filled according to the invention the material of the lower tape 32, in which the cavities are formed, is preferably made of aluminium, plastic materials or laminates of these two materials, which can be heat or cold formed, but any other suitable material may be used.

The protective tape is preferably made of a thin aluninium foil but could of course be made of any other suitable material having a sealing and covering function. The material should preferably be impermeable to moisture and light as many finely divided powdered medicaments are hygroscopic and sensitive to light. It is however, in the case of a unit dose inhalator, important for the easy handling of the inhalator that the tape is easy to remove from the upper side of the elongate member and cavity as well as from the lower side of the elongate member if the cavity is provided with a hole.

The method, device and apparatus according to the invention is suitable to be used for filling any type of finely divided powdered medicament consisiting of one or more substances.

MODIFICATIONS

The method, device and apparatus as described above can of course be modified within the scope of the appended claims.

Thus the construction of the filling head may be modified in order to meet requirements arising from filling of different types of powders:

For example, the stirring device can be modified further. A whisk-like device can for example be used which has a similar function, namely to break down the aggregates formed in the finely divided powder and to transport the powder down into the cavities and to compact it therein.

In the preferred embodiment of the invention an electrically driven motor with driving wheels and a transmission belt have been used but any other suitable means could be used for providing and transmitting a movement to the main shaft.

The material of the layers as well as the materials of the filling head and the stirring device can be modified. The apparatus according to the invention can also be modified to fill exact quantities of finely divided powdered medicament into cavities formed in, or on, single pieces of plastics or similar, preferably made of moulded plastic, whereby each piece constitutes a bottom plate to be used as a carrier member for the cavity to be filled with powder in the production of a unit-dose, breath-actuated, dry powder inhalator.

In the preferred embodiment the filling device is adjustable in its position in relation to the cavity both horisontally and vertically. The supporting frame 17 is horisontally adjustable in its mounting on the stand comprising the motor. The mounting element 18 is vertically adjustable-in-relation to the supporting frame 17.

We claim:

1. A device for delivering a predetermined dose of a finely divided powder having an average particle size of less than 10 $\mu$m into a packaging cavity formed of a depression in an elongate member, comprising a filling head constructed to deliver said predetermined dose of said finely divided powder to said cavity, and to oscillate with respect to said cavity during delivery to break down aggregates formed in the finely divided powder and to provide controlled compaction of the powder in said cavity, said filling head including a powder compartment disposed in said filling head and having an opening to said cavity underneath said compartment, said filling head also including a stirring element disposed in said powder compartment, said stirring element being aligned with said cavity during the delivery of a dose of finely divided powder and oscillation of said compartment with respect to said stirring element and said cavity, said stirring element being constructed to rotate about its axis;

said stirring element rotating to engage said finely divided powder in said compartment to fill said cavities while said compartment of said filling head oscillates.

2. The device of claim 1 wherein said predetermined dose is from about 0.1 mg to 10 mg.

3. The device of claim 1 wherein said stirring element includes a brush portion that is constructed to transport powder from the filling head to the cavity.

4. The device of claim 1 wherein said stirring element includes a substantially cylindrical portion having apertures constructed to transport powder from the filling head to the cavity.

5. The device of claim 1 further comprising a screw feeder positioned to deliver said powder to said powder compartment.

6. A method of delivering a predetermined dose of a finely divided powder having an average particle size of less than 10 μm into a packaging cavity formed of one of a plurality of depressions in an elongate member, comprising providing a filling head constructed to deliver said predetermined dose of said finely divided powder to said cavity, said filling head including a powder compartment disposed in said filling head and having an opening to said cavity underneath said compartment, providing a stirring element disposed within the filling head and aligned with said cavity, oscillating said filling head with respect to said cavity and with respect to said stirring element during delivery to break down aggregates formed in the finely divided powders and rotating said stirring element about its axis during filling of the cavity to transport the powder to the cavity and to provide controlled compaction of the powder in said cavity, said stirring element rotating to engage said finely divided powder in said compartment to fill said cavities while said compartment of said filling head oscillates.

7. The method of claim 6 wherein the predetermined dose is from about 0.1 to 10 mg.

8. The method of claim 6 wherein said powder is a powdered medicament.

9. A method of manufacturing an elongate carrier with cavities containing a finely divided powder having an average particle size of less than 10 μm, comprising (a) providing a first elongate member having a plurality of cavities spaced along its length;

(b) delivering a predetermined dose of the finely divided powder into each cavity by positioning an oscillating filling head above the cavity, said filling head having a powder compartment, said filling head constructed to oscillate around said stirring element while said stirring element remains aligned with said cavity, transporting the powder from the filling head to the cavity and providing controlled compaction of the powder within the cavity by rotating said stirring element about its axis;

said stirring element rotating to engage said finely divided powder in said compartment to fill said cavities while said compartment of said filling head oscillates; and (c) sealing a second elongate member to the first elongate member.

10. The method of claim 9 further comprising sealing a protective tape over each cavity to seal the powder within the cavity.

11. The method of claim 9 further comprising cutting the elongate carrier into a plurality of portions, each portion containing a predetermined number of cavities.

12. The method of claim 11 wherein each portion contains a single cavity.

13. The method of claim 9 wherein said finely divided powder is a powdered medicament suitable for use in a dry powder inhaler.

14. A method of making a dry powder inhaler comprising (a) providing a first elongate member having a plurality of cavities spaced along its length;

(b) delivering a predetermined dose of a finely divided powder into each cavity by positioning an oscillating filling head above the cavity, said filling head having a powder compartment and a stirring element disposed within said powder compartment, said filling head constructed to oscillate around said stirring element while said stirring element remains aligned with said cavity, and transporting the powdered medicament from the filling head to the cavity and providing controlled compaction of the powdered medicament within the cavity by rotating said stirring element about its axis, said stirring element rotating to engage said finely divided powder in said compartment to fill said cavities while said compartment of said filling head oscillates;

(c) sealing a second elongate member to the first elongate member to form an elongate carrier;

(d) cutting the elongate carrier into a plurality of portions, each portion containing a predetermined number of cavities; and (e) placing one of said portions in a dry powder inhaler.

15. The device of claim 1 wherein said filling head is constructed so that said oscillation describes an arc.

16. The method of claim 6 wherein said oscillating step includes moving said filling head in an arcuate path.

17. The device of claim 1 wherein said packaging cavity has a volume substantially equal to the volume of the predetermined dose.

18. The method of claim 6 wherein said packaging cavity has a volume substantially equal to the volume of the predetermined dose.

19. A device for delivering a predetermined dose of a finely divided powder having an average particle size of less than 10 μm into a packaging cavity formed of a depression in an elongate member, comprising a filling head constructed to deliver the powder to said cavity and to oscillate, by moving in a circular path with respect to said cavity, during the delivery of the powder to break down aggregates formed in the finely divided powder and to provide controlled compaction of the powder in said cavity, said filling head including a powder compartment disposed in said filling head, said filling head also including a stirring element disposed in said powder compartment, said stirring element being aligned with said cavity during the delivery of the powder, said stirring element constructed to rotate about its axis;

said stirring element rotating to engage said finely divided powder in said compartment to fill said cavities while said compartment of said filling head oscillates.

* * * * *